United States Patent [19]

Herren

[11] Patent Number: 5,028,316

[45] Date of Patent: Jul. 2, 1991

[54] MOUNTING SYSTEM FOR SCREEN RAILS

[76] Inventor: Harold L. Herren, 802 Main St., Platteville, Colo. 80651

[21] Appl. No.: 468,626

[22] Filed: Jan. 23, 1990

Related U.S. Application Data

[63] Continuation-in-part of Ser. No. 396,869, Aug. 22, 1989.

[51] Int. Cl.[5] ..... B07B 1/46

[52] U.S. Cl. ..... 209/403; 209/319

[58] Field of Search ..... 209/319, 398, 399, 401–405, 209/408, 409, 412, 415

[56] References Cited

U.S. PATENT DOCUMENTS

| | | | |
|---|---|---|---|
| 2,077,678 | 4/1937 | Delamater | 209/415 X |
| 2,630,225 | 3/1953 | Bye | 209/403 |
| 3,092,573 | 6/1963 | Lambert et al. | 209/403 |
| 3,346,114 | 10/1967 | Hoyt | 411/537 X |
| 4,735,712 | 4/1988 | Herren et al. | 209/401 X |

FOREIGN PATENT DOCUMENTS

| | | | |
|---|---|---|---|
| 1026147 | 4/1953 | France | 209/403 |
| 1253672 | 8/1986 | U.S.S.R. | 209/403 |

*Primary Examiner*—Michael S. Huppert
*Assistant Examiner*—Edward M. Wacyra
*Attorney, Agent, or Firm*—Dean P. Edmundson

[57] ABSTRACT

A mounting system for removably attaching elongated screen rails to upright side panels of a screen deck for screening crushed rock and gravel. A method for suspending a screen rail within the screen deck is disclosed which avoids the need to remove the screen rails when changing screens. In one embodiment, a plurality of anchors are secured to one side of each screen rail, and bolts are used to secure the rails to the side panels. The anchors each include an opening which is larger at the top than at the bottom to allow the head of the bolt to be readily and easily captured by the anchor. The mounting system is much easier to use and much more rapid than previous systems.

10 Claims, 4 Drawing Sheets

MOUNTING SYSTEM FOR SCREEN RAILS

CROSS-REFERENCE TO RELATED APPLICATION

This is a continuation-in-part of my copending application Ser. No. 396,869, filed Aug. 22, 1989.

FIELD OF THE INVENTION

This invention relates to screen decks of the type used for screening crushed rock and gravel to separate it into various segments according to size. More particularly, this invention relates to systems for attaching or mounting screen rails to the upright side walls of a screen deck.

BACKGROUND OF THE INVENTION

Side rails are commonly used for tensioning and supporting screens in a screen deck. The side rails are removably attached to upright side walls or panels in the deck in a manner such that the rails engage a screen at its side edges and tension the screen in a secure manner.

Multiple vibrating screens are normally used, with a top screen separating the largest size of material, such as sand, gravel, crushed stone and the like, with the material which passes through the top screen falling onto an intermediate screen. The intermediate screen separates an intermediate size of material, with the remainder falling through the intermediate screen onto a finer screen, which in turn separates the larger particles of those falling onto it and the smallest size falling through for collection beneath.

Different techniques have been utilized to removably attach the screen rails to the side walls or panels. For example, one very common technique involves the use of bolts or pins which extend through apertures in the screen rails and corresponding apertures in the side walls. A fastener is then used to secure the bolt or pin in place. The bolt or pin head is thus located on the side of screen rail which is exposed to the rock being screened or sorted.

The entire screen deck assembly is then vibrated, usually to produce a slow forward movement and a rapid rearward movement, so that the rock material will move forward with the screen but, due to inertia will permit the screen to move rearwardly under it. As a result, the rock material will work its way forwardly on the respective screen, so that material which does not fall through the screen will be discharged from the front end of the respective screen, for collection.

In order to remove a screen, it has heretofore been necessary to remove the nut from each bolt outside the wall or panel and then reach inside the assembly to pull the bolts out of the side rail. After the old screen has been replaced by a new screen, it is necessary to insert each bolt, from the inside, through a hole in the screen rail and then through the hole in the side wall or panel, after which the nut may be replaced and tightened. As will be evident, since the side walls or panels prevent access to, and any view of, the side rail, from the outside of the panel, little help from someone on the outside of the panel may be obtained, except to place the washer and nut on the threaded end of the bolt, after it has been pushed through the hole in the side panel. The removal of the bolts, as well as replacing them, adds to the time consumed and the expense of changing a side rail or screen.

A similar procedure, of course, is used when using pins instead of threaded bolts. The pins include an elongated slotted aperture into which a wedge-shaped retainer is driven to tension the pin after it has been inserted through registering holes or openings in the screen rail and the side wall or panel.

Metal side rails for tensioning vibrating screens are subject to undue wear, thus requiring relatively frequent replacement. A layer of rubber may be molded onto the side rail, above a flange which receives a side strip attached to the screen, as by welding, and has a hook which engages the flange. Such a layer increases the useful life of the side rail considerably.

One technique which has been previously proposed for attaching side rails to avoid the problems discussed above involved the use of an anchor on the side of the rail facing the side wall and a bolt or pin having a hook at one end. The hook is intended to engage the anchor when the bolt or pin is inserted through an opening or aperture in the side rail and then rotated. This technique requires the use of special bolts or pins and has not been widely accepted. Also, it is not easy for the workman to determine with certainty whether the bolt or pin is properly positioned to engage the side rail.

Another problem associated with changing of screens in a screen deck is that it is necessary to completely remove the side rails from the deck after they have been loosened. This requires additional time and work.

There has not heretofore been provided an effective, safe and efficient mounting system for removably attaching side rails to side walls or panels of a screen deck using conventional bolts and pins.

SUMMARY OF THE PRESENT INVENTION

In accordance with the present invention there is provided a system for temporarily suspending the loosened side rails within the screen deck in a manner such that the screens can be removed from the deck without removing the rails. Then after the new screens have been inserted, the side rails can be easily lowered into place and secured by means of conventional bolts or pins.

In accordance with the present invention there is also provided a mounting system for removably attaching a side rail to a side wall or panel in a screen deck. The mounting system comprises a plurality of anchor members secured to one side of each screen rail. Each anchor includes an opening which faces a side panel of the screen deck. The opening includes upper and lower portions, the upper portion being wider than the lower portion.

A conventional bolt having an enlarged head extends through an aperture in the side panel of the screen deck and the head of the bolt is captured or retained by the anchor. The shank of the bolt passes through the opening in the anchor and also passes through a registering aperture in the side panel. Then a fastener (e.g., a threaded nut or a wedge pin) is affixed to the outer end of the bolt on the outside of the side panel. As the fastener is tightened the screen rail is drawn or urged closer to the side panel. The screen is thereby tensioned and retained in proper position.

With the mounting system of this invention it is not necessary to remove the bolts from the screen deck in order to change or replace the screen. Rather the bolts are loosened only to the extent necessary to enable the head of each bolt to be released or disengaged from the anchor on the screen rail. Then the screen rails can be removed to allow a new screen to be inserted, after which the screen rails can be secured in place with the bolts. Each bolt can be manipulated from a position outside the screen deck to engage an anchor on a screen rail.

Also, a further advantage is that the conventional bolts or pins may be used. There is no need to use special bolts or pins.

The system of this invention also enables each loosened screen rail to be temporarily suspended within the screen deck when replacing screens. This saves considerable time and labor.

The mounting system of the invention also avoids much of the time and labor normally required to attach screen rails to a screen deck. Further, the system of the invention avoids the need to have a person inside the screen deck to insert bolts through the screen rails.

Other advantages of the invention will be apparent from the following detailed description and the appended drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
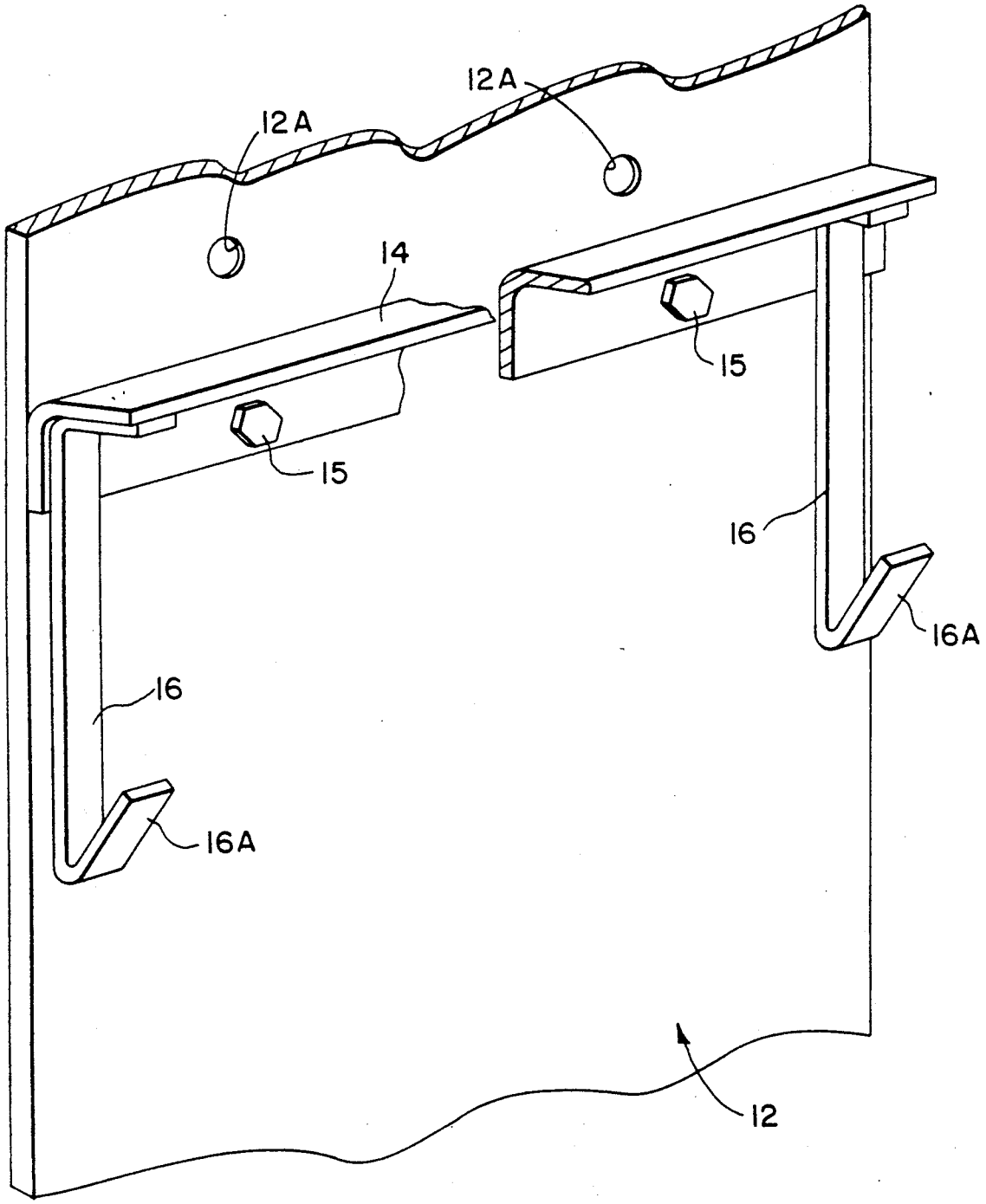
FIG. 1 is a perspective view of a side panel of a screen deck which includes one embodiment of rail suspension system of the invention.

FIG. 1 is a perspective view illustrating one form of hanger system which is useful in the techniques of this invention. Thus, there is shown a vertical side panel 12 of a conventional screen deck of the type which typically supports a plurality of screens. In such a screen deck there are two such vertical side panels which are spaced apart by a distance slightly greater than the width of the screens. Normally the screens are parallel to each other and are vertically spaced.

Each side edge of a screen rests upon a screen support or rest 14 which extends longitudinally along the length of the screen deck. The screen support is fastened to the side panel by means of bolts 15. Because of the strength required in the side panel, the screen supports are secured to the side panel by means of bolts. This avoids the need to weld the screen supports in place. Welding can weaken the side panel and allow undesirable cracks to develop.

Fastened to the underside of each screen support 14 are depending hangers 16 which include an upturned end 16A. Typically one hanger is fastened adjacent each end of a screen support 14, as illustrated. The distance to which each hanger may depend from the screen support may vary, as desired.

The openings 12A in the side panel are for the purpose of receiving bolts used to fasten the screen rails in place. The screen rails secure the screens between the two upright side panels.

Figure 2:
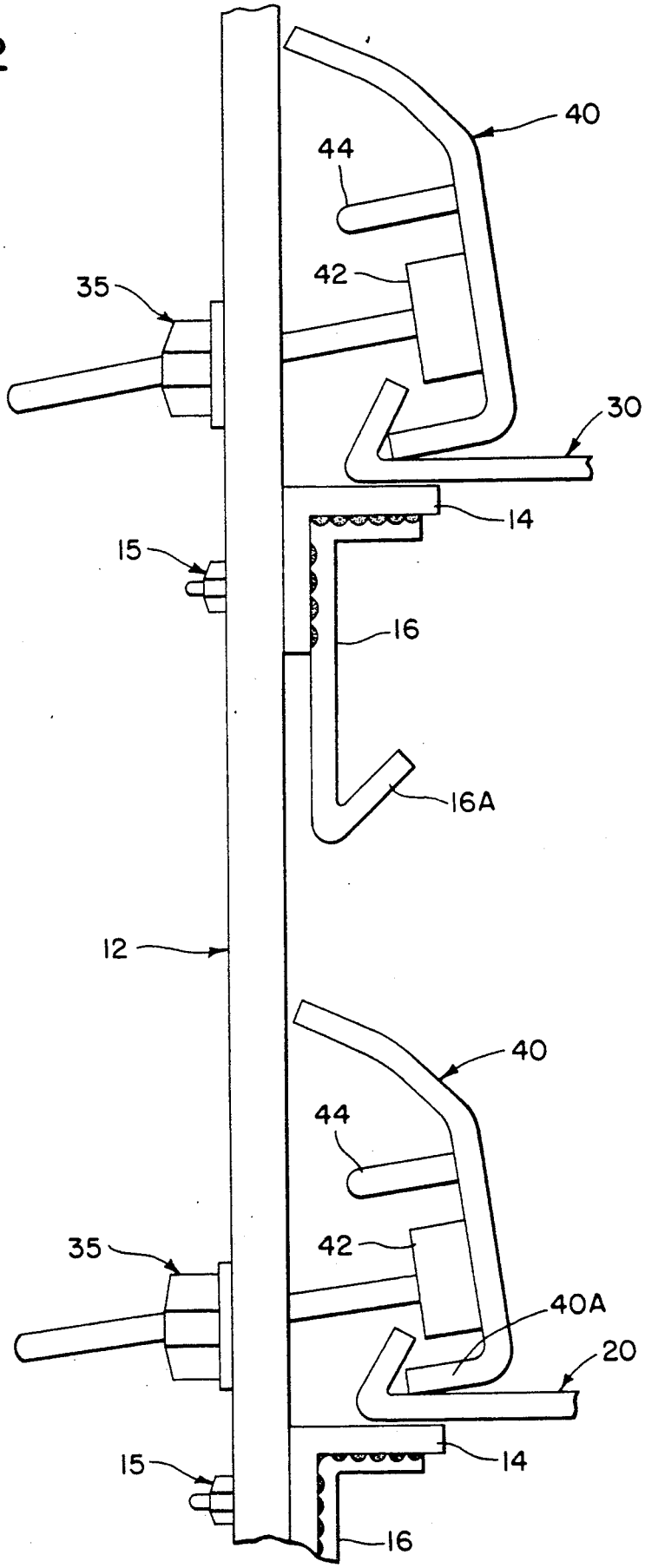
FIG. 2 is a side elevational view of one side of a screen deck including the suspension system of FIG. 1 and a rail mounting system.

FIG. 2 is an elevational view showing two screens 20 and 30 fastened to side panel 12 of a screen deck. The edge of each screen rests upon a corresponding screen support 14. Screen rails 40 (of the type shown in FIG. 3) engage the edge of the screens and urge them toward the side panel as bolts 35 are tightened. The head of each bolt is captured in anchor 42 secured to the inside surface of respective screen rail 40.

The hook 16A at the lower end of each hanger 16 is typically located a few inches above the lower screen rail. The upper end of hanger 16 is preferably welded to the underside of screen support 14, as illustrated. Because of the danger of weakening or cracking the side panel by welding, it is not desired to weld the hanger directly to the side panel. Rather, it is preferred to weld it to the screen support 14, as shown.

Figure 3:
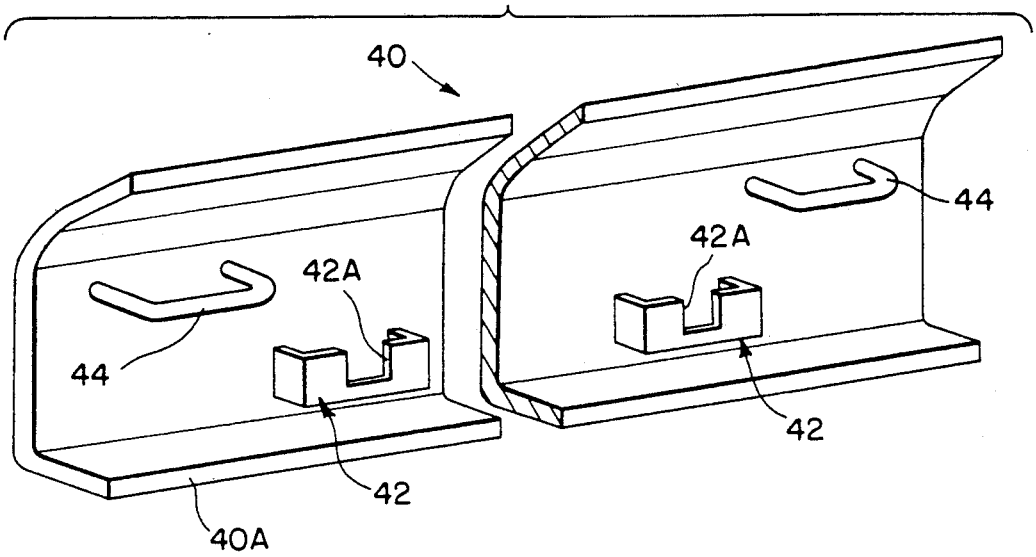
FIG. 3 is a perspective view of a rail which includes hook members and anchors used in one embodiment of the invention.

FIG. 3 is a perspective view of an elongated screen rail 40 which has secured to one side thereof a plurality of spaced anchor members 42. Typically the screen rail includes a lower leg 40A projecting toward the side on which the anchors are secured. The leg 40A may be in the form of a continuous flange, as illustrated, which extends along the entire length of the rail.

The upper portion of the screen rail is curved or arced to the same side of the rail as the leg extends. The term "curved" as used herein is intended to include a rounded bend as well as a series of straight sections at an angle with respect to each other, as illustrated in the drawings.

Between the upper and lower edges of the screen rail the anchor members 42 are secured as illustrated. The spacing between adjacent anchor members may vary, depending upon the spacing between adjacent apertures 12A in the side walls or panels 12 of the screen deck. For example, the spacing between adjacent anchors may be 12 inches, 16 inches, 20 inches, etc., as required.

Typically the screen rails are composed of metal (e.g., steel) and the anchor members are also made of steel. The anchors are welded to the screen rail after determining the desired spacing between adjacent anchors.

The embodiment of anchor 42 illustrated is generally U-shaped and includes leg portions which are intended to be welded to the screen rail. The front portion is generally planar and includes an opening 42A for receiving a bolt during mounting. The opening may be wider at the top than at the bottom thereof so as to facilitate insertion and capture of the bolt which extends through an aperture in the screen deck. In other words, the bolt or pin does not have to be perfectly aligned with the anchor when it is inserted therein.

The opening 42A as shown in FIG. 3 is essentially square although it may be star-shaped (i.e., it includes some square corners) so that the square shoulder of a bolt head will engage the opening and be prevented from rotating when a fastener (e.g., nut) is threaded onto the outer end of the bolt. The presence of square corners is helpful for accommodating square shoulders on bolts used to attach the screen rail to the side wall or panel. This prevents such type of bolts from rotating when a threaded fastener is secured to the outer end of the bolt.

As illustrated in FIG. 2, bolts or pins 35 include a head portion which is captured and retained within the anchor 42. The shank portion extends through an aperture in the side wall or panel. The outer end of the bolt or pin is secured by means of a suitable fastener. When the bolt is threaded, then a threaded fastener (e.g., a nut) is affixed to it and tightened. When the bolt or pin is not threaded, then preferably it includes a slotted longitudinal aperture. A wedge is driven into the slotted aperture to draw the pin tight and urge the screen rail toward the side wall. Spacers may also be included between the wedge and the side wall.

FIG. 3 also illustrates the attachment means 44 which are secured adjacent each end of a screen rail 40 to the inside surface thereof. Typically these attachment means are U-shaped members which project outwardly from the inside surface of the screen rail, as illustrated, to define an eyelet or attachment device which enables the screen rail to be temporarily connected to or suspended from the hooks 16A on hangers 16.

It has been found that the upper portion of the screen rail must be either curved (with a single continuous bend) or it must be arced with at least two arcs so that the head of a bolt or pin is properly directed downwardly toward the anchor. If one of these arc portions is not present then the head of the bolt or pin is not properly directed downwardly toward the anchor. In other words, it is not sufficient to simply eliminate the intermediate section and connect the upper section to the lower section at a 45° angle.

As illustrated in the drawings, the lower edge of the anchor is also spaced above the leg portion 40A of the screen rail. This also assures that the up-turned flange or hook at the edge of the screen does not contact the anchor 42 when the screen rail is urged toward the side wall or panel.

The height of the screen rail 40 is preferably no greater than about 4 inches. Some screen decks do not have sufficient space to enable a taller screen rail to be used. Also, taller screen rails are heavier. The width of the screen rail is preferably about 2 inches. The center of the opening 42A in the front portion of the anchor is preferably about 1.5 inches above the lowermost edge of the screen rail so that the bolt or pin used to fasten the screen rail will not contact the up-turned flange or hook of the screen.

The length of leg portion 40A is preferably about 1.5 inches or more. This helps to assure that the hook or up-turned flange of the screen will not contact the anchor.

Preferably the anchor 42 is mounted or secured as low on the screen rail as possible so that the bolt or pin used to fasten it will pull straight (or within about 10° of straight) during tightening. In other words, it is desired to achieve horizontal alignment between the bolt or pin and the aperture in the side wall or panel of the screen deck for proper tensioning of the screen.

The apertures 12A in the side walls 12 of the screen deck are small and do not allow visual access to the inside of the screen deck when the bolts or pins are present. Also, there is a limited area available for maneuvering of the bolt or pin when the screen rail is present.

The anchor system described herein enables the head portion of the bolt or pin to be easily and readily inserted into the anchor and captured there even without visual access to the anchor. Also, when it is desired to remove the screen rails to replace a screen, the bolts or pins may be partially loosened and then unhooked from the anchor by pushing the head portion upwardly. It is not necessary to completely remove the nut from a threaded bolt, for example. This saves much time and labor and accordingly reduces the cost of replacing screens.

Also, the mounting system of this invention protects the heads of the bolts or pins from wear and damage because the heads are never exposed to the rock or gravel being screened. This is a significant advantage.

Another significant advantage is that there is no need to purchase or use special bolts or pins to attach the screen rails. Rather, the existing conventional bolts and pins may be used without modification. Also, bolts or pins of different sizes can be accommodated by making the opening in the anchor any desired size.

Figure 4:
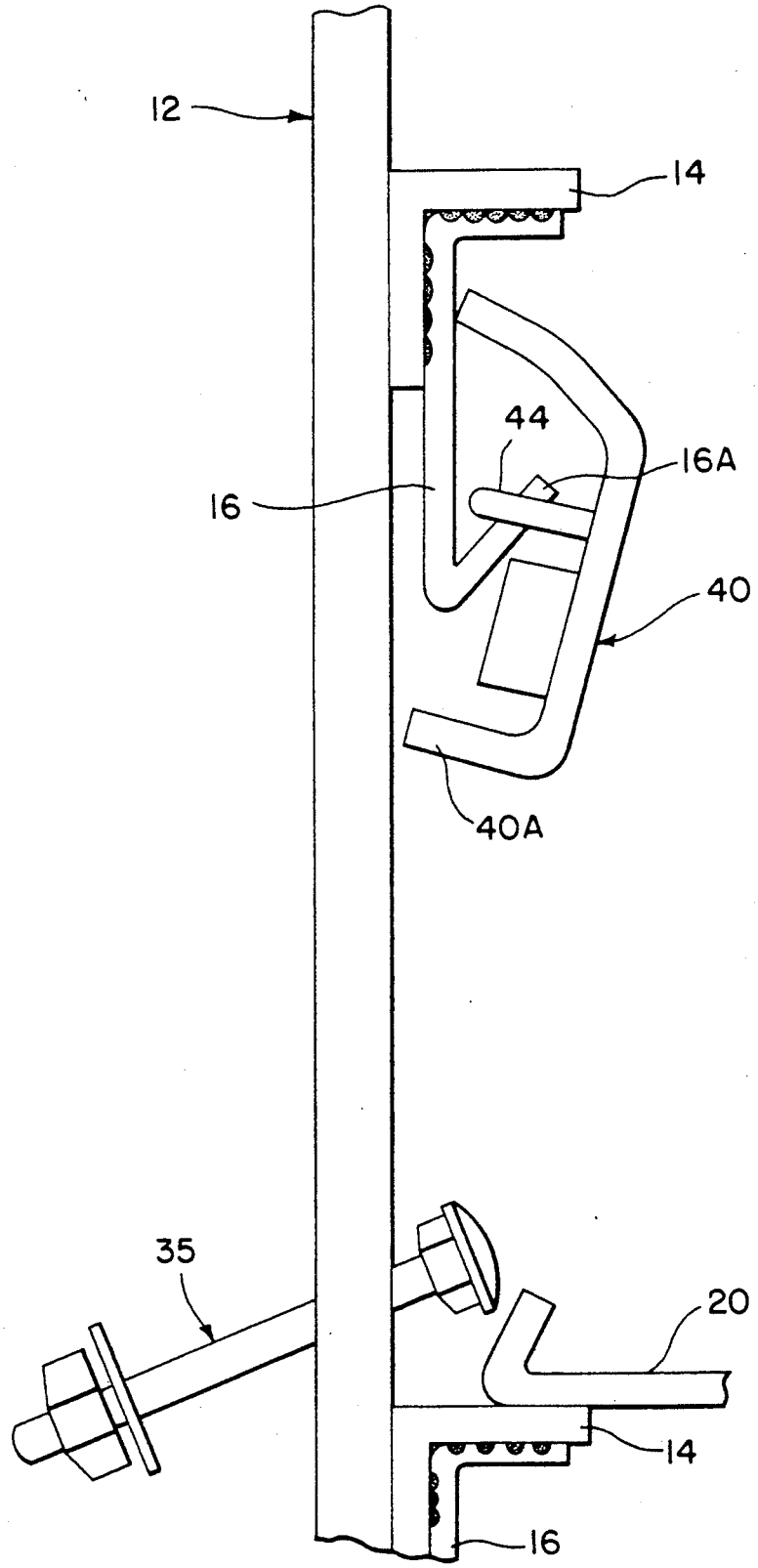
FIG. 4 is a cross-sectional view illustrating the manner in which a rail can be temporarily suspended from a side wall of a screen deck above a screen in accordance with this invention.

FIG. 4 illustrates the manner in which a loosened screen rail 40 can be easily and effectively suspended above a screen 20 by means of attachment means 44 and hook 16A on hanger 16. By simply hanging or suspending the screen rails 40 above the screen, it avoids the need to physically remove the screen rails from the screen deck in order to change the screens in the deck. This system accordingly saves considerable labor.

Figure 5:
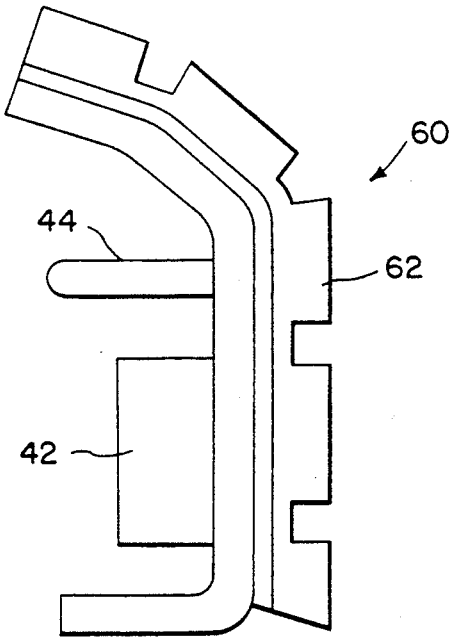
FIG. 5 is an end view of another type of rail including an anchor and attachment means of the invention.
Figure 6:
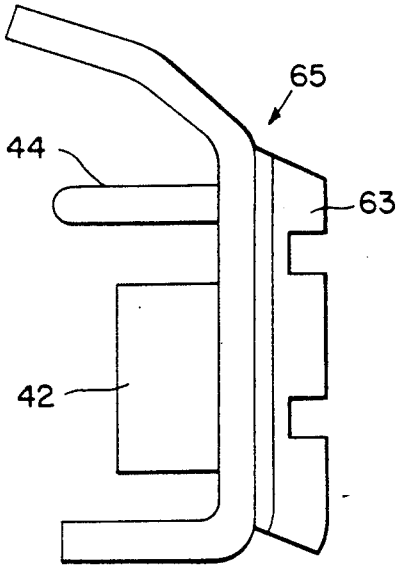
FIG. 6 is an end view of yet another type of rail including an anchor and attachment means of the invention.

FIGS. 5 and 6 are end views of two other embodiments of screen rails 60 and 65 which have the configuration shown for screen rail 40 but further include rubber layers to reduce wear during use. Screen rail 60 is shown including a rubber layer 62 covering only the entire surface of the screen rail. Screen rail 65 is shown including a rubber layer 63 covering only the lower half of the screen rail which is exposed to the rock, gravel, etc.

For the purposes of this invention, the reference to a "bolt" includes reference to a non-threaded pin. The only difference is that a nut is used as a fastener on a threaded bolt, and a wedge is normally used as a fastener for a pin which includes a slotted aperture.

The length of the screen rails may vary. For example, lengths in the range of about 4 feet to 10 feet are common. The number of anchors used, and the spacing between anchors on the screen rail, may also vary depending upon the spacing between the apertures in the side walls or panels of the screen deck.

Thus, the system of the present invention enables more efficient, rapid, and easier changing of the screens in a screen deck. There is no need to remove the screen rails from the screen deck, and there is no need to remove the bolts which secure the screen rails in place.

Other variants are possible without departing from the scope of this invention.

I claim:

1. In a screen deck of the type including spaced-apart upright side panels, a screen supported between said side panels, and screen rails detachably secured to said side panels for retaining said screen between said side panels, wherein the improvement comprises a screen rail suspension system for temporarily suspending said screen rails within said screen deck after said screen rails have been detached from said side panels, wherein said suspension system comprises:

(a) hook members carried by each said side panel;

(b) attachment means carried by each said screen rail; wherein said side rails are adapted to be suspended from said hook members by attachment of said attachment means to said hook members;

wherein said screen deck further includes elongated screen supports secured longitudinally to said side panels, and wherein said hook members are secured to said screen supports.

2. A suspension system in accordance with claim 1, wherein said attachment means comprises U-shaped members secured to said screen rails.

3. A suspension system in accordance with claim 2, wherein each said screen rail includes first and second ends, and wherein a said U-shaped member is secured to said screen rail adjacent to each said end.

4. A suspension system in accordance with claim 1, wherein said hook members each comprise an elongated bar having first and second ends, wherein said first end is secured to a said screen support, and said second end depends downwardly and includes a hook.

5. A screen deck of the type including a screen retained between upright side panels each having a plurality of spaced apertures therein; wherein said screen is tensioned and retained by means of an elongated screen rail disposed along each side edge of said screen; wherein each said screen rail includes first and second side surfaces and upper and lower portions; wherein said upper portion is curved in the direction of said first side surface; and wherein said lower portion includes a leg projecting in the direction of said first side surface; wherein the improvement comprises:

(a) a plurality of anchor members secured to said first side surface of said screen rail; wherein each said anchor member includes an opening facing said side panel; wherein said opening includes upper and lower portions; wherein said upper portion of said opening is wider than said lower portion thereof;

(b) a plurality of elongated bolts each having first and second ends; wherein said first end includes an enlarged head;

(c) a plurality of fastener members, each of which is adapted to engage said second end of a said bolt;

(d) at least two U-shaped attachment members secured to said first side surface of each said screen rail;

(e) at least two hook members carried by each said side panel; wherein said hook members each comprise an elongated bar;

wherein said first end of each said bolt is captured in said opening of a said anchor and said second end of said bolt passes through a said aperture in said side panel; wherein a said fastener is adapted to engage said second end of a said bolt and thereby secure said bolt and said screen rail to said side panel; wherein when said screen rails are detached they can be temporarily suspended from said hook members.

6. The improvement of claim 5, wherein said bolt is threaded and includes a square shoulder adjacent said head; and wherein said opening in each said anchor member is adapted to capture said shoulder and prevent rotation of said bolt.

7. The improvement of claim 5, wherein said anchor member is U-shaped and includes upper and lower edges; wherein said upper edge includes said opening; and wherein the distance between said upper edge and said first side surface is greater than the distance between said lower edge and said first side surface.

8. A method for changing a screen in a screen deck, wherein an elongated screen rail is removably attached to an upright side panel of said screen deck, wherein said side panel includes a plurality of spaced apertures therein; wherein said side panel includes a screen support; wherein said screen rail includes first and second side surfaces and upper and lower portions; wherein said upper portion is curved in the direction of said first side surface; and wherein said lower portion includes a leg projecting in the direction of said first side surface; the method comprising the steps of:

(a) providing a U-shaped attachment member adjacent each end of each said screen rail;

(b) providing at least two hook members carried by each said side panel;

(c) detaching said screen rail from said side panel;

(d) suspending said screen rail from said hook members;

(e) removing said screen from said screen deck and inserting a new screen;

(f) disconnecting said screen rail from said hook members; and (g) securing said screen rail to said side panel in a manner such that said new screen is retained in said screen deck.

9. A method in accordance with claim 8, wherein said screen rail includes a plurality of U-shaped anchor members each having upper and lower edges; wherein said upper edge includes an opening; wherein said screen rail is secured to said side panel by means of a bolt extending through said anchor member and said side panel.

10. A method in accordance with claim 9, wherein said bolt is threaded and includes a square shoulder adjacent said head; and wherein said opening in each said anchor member is adapted to capture said shoulder and prevent rotation of said bolt.

* * * * *